US005871302A

United States Patent [19]

Carlson

[11] Patent Number: 5,871,302

[45] Date of Patent: Feb. 16, 1999

[54] TRUSS ASSEMBLY SYSTEM

[76] Inventor: Gregory P. Carlson, 5955 Churchill, Shoreview, Minn. 55126

[21] Appl. No.: 769,239

[22] Filed: Dec. 18, 1996

[51] Int. Cl.[6] ..... E01C 19/38

[52] U.S. Cl. ..... 404/96; 404/114

[58] Field of Search ..... 404/96, 113–115, 404/119, 118

[56] References Cited

U.S. PATENT DOCUMENTS

| | | | |
|---|---|---|---|
| 4,124,325 | 11/1978 | Cutler | 404/75 |
| 4,349,295 | 9/1982 | Morrison | 404/119 X |
| 4,577,994 | 3/1986 | Miller | 404/114 |
| 4,701,071 | 10/1987 | Morrison | 404/114 |
| 4,931,008 | 6/1990 | Morrison | 425/456 |
| 4,950,101 | 8/1990 | Artzberger | 404/114 |
| 5,664,908 | 9/1997 | Paladeni | 404/119 X |

*Primary Examiner*—James Lisehora
*Attorney, Agent, or Firm*—Nawrocki, Rooney & Sivertson, P.A.

[57] ABSTRACT

A vibratory concrete screed including alternating turnbuckles and tubular housings, mated together for adjusting tension and screeding surface camber. The turnbuckles and tubular housings include interior space therethrough which houses an elongate rotatable shaft for providing vibration. The elongate shaft includes eccentric weights rotating within bearings within the turnbuckles and driven by drive shafts driven in turn by a motor located at one end of the screed. The screed includes male and female joiner pieces having mating bearing surfaces for securing abutting screed sections. The invention also includes a laser alignment system for adjusting camber.

12 Claims, 4 Drawing Sheets

TRUSS ASSEMBLY SYSTEM

FIELD OF THE INVENTION

The present invention relates generally to the field of concrete finishing devices. More specifically, the invention relates to an improved, long span, vibrating concrete screed.

BACKGROUND OF THE INVENTION

Concrete screeding devices are used to finish freshly poured concrete pavements. Freshly poured concrete contains aggregate, cement, and entrained air, and requires smoothing. The concrete is commonly poured between forms at either side of the roadbed. Finishing is accomplished by use of a vibrating screed. The screed is typically formed of a beam or truss structure which spans and sits atop the concrete forms on either side. Long span screed structures are formed of abutting shorter sections attached together longitudinally. The bottom of the structure includes a bottom plate having a smooth screeding surface which smooths the concrete.

A motor is commonly mounted on the screed to provide a source of vibration. Vibrations are transmitted to the screed structure which transmits the vibrations to the concrete below via the screeding surface. The device is pulled laterally over the concrete, either automatically or by an operator on either side. As the screed is moved over the concrete, the concrete liquifies and slumps in response to the vibrations and smoothing actions of the screed. The vibration may be transmitted from the motor directly to the screed frame, which results in poor vibration and poor concrete finish in areas remote to the vibratory motor. The vibration may be distributed over the screen length by a drive shaft with eccentric weights. Such a shaft and any associated bearings and pulleys can become fouled with wet then dry concrete.

The finished concrete should be both substantially level relative to the earth and have the desired surface contours. Desire contours include having the center higher than the shoulders, "a crown", and having the center lower, "an invert." Screeds must therefore be adjustable such that the bottom screeding surface assumes an upward and downward camber, respectively. Screeds require time to align and interconnect for the desired surface, and can come out of alignment during use, due in part to the vibrations and poor connection between sections. A system for monitoring alignment in use would be desirable.

Screeds are formed of short sections to allow transportation to work sites. The sections must be attached together so as to provide a rigid structure capable of delivering the desired surface contour. In particular, the sections must be attachable to create smooth crowns and inverts, as well as flat surfaces. Loss of rigidity can cause a vertical bowing of the structure, resulting in the center portion drooping. Loss of rigidity can also cause a lateral bowing of the screed structure, with the center portion lagging laterally behind the end portions. Lateral bowing can cause the center portion bottom plate to angle into, or "toe into" the concrete, causing the leading edge to dig into the concrete to be smoothed. This is less than desirable behavior, defeating the smoothing function of the screed.

Sections must be attachable in such a way to allow sufficient freedom to achieve the desired surface contour, while providing needed rigidity. Currently available methods for attaching sections together utilize short, vertically oriented connecting plates having holes, for bolt attachment to vertical angle iron sections on adjacent screed sections being abutted. The attachment plates provided are not attached to the horizontal, screed bottom plate as any bolts through the bottom plate would mar the concrete finish. The reliance on attachment to vertical surfaces only is inherently rigid in one dimension but weak in others.

The use of bolts for attachment close to wet concrete on a vibrating device results in bolts being covered with wet, then dried, and therefore extremely abrasive concrete. When the concrete dries it becomes difficult to remove the dried material, and, consequently, it becomes extremely difficult to remove assembly bolts and nuts which become encrusted. It will be seen then that one significant problem is that disassembly can become virtually impossible.

The constant vibration of the vibratory motor can also cause fatigue and eventual failure at the point of attachment between bolt, connecting plate, and screed section. Concrete dust between bolt and the surrounding holes in plate and screed sections acts as a grinding agent, wearing the holes larger, increasing play between bolt and hole, causing more fatigue. Increased play between screed sections causes the screed bottom plate camber to come out of adjustment. This in turn makes continual alignment checks desirable.

What remains to be provided is an improved means for attaching two screed sections together which is rigid, allows for a smooth bottom plate, and which is not easily fouled by wet cement. What has not been provided is a system that distributes vibrations over a screed that is not easily fouled. What would also be desirable is an easy to use system for monitoring screed section alignment during use.

SUMMARY OF THE INVENTION

The present invention provides an improved vibratory concrete screed for finishing wet concrete. The screed has a longitudinal axis extending across the concrete to be smoothed and includes a bottom portion having a smooth screeding surface and a top portion having a means for tensioning the screed. Adjusting the tensioning means adjusts the local screed surface camber from an upward camber, through a level geometry, to a downward camber.

The preferred screed tensioning means includes turnbuckles mated to tubular housings, where both turnbuckles and tubular housing have interior space extending therethrough. The invention includes an elongate, rotatable shaft for imparting vibration to the screed, the elongate shaft extending through the interior space within the tubular housings and turnbuckles. A preferred elongate shaft includes eccentric weight portions residing within the turnbuckles. A preferred embodiment also includes drive shaft sections mated to axle portions utilizing spline or other types of couplings, with the axle portions mounted within ball bearings within the turnbuckles. The eccentric weights lie between axle portions and provide vibration when rotated about the longitudinal axis.

In one embodiment, the tubular housings have male threads fitting within female turnbuckle threads, where opposite turnbuckle ends are threaded in opposite directions. The means for vibrating the screed is thus enclosed and protected from wet spattered concrete and dried concrete dust. The rotating shaft members and bearings are thus shielded from concrete buildup and continual wear from exposure to the abrasive dust. This decreases both planned maintenance with the attendant costs, and unplanned maintenance with the attendant delays.

The invention also provides a conjunction assembly for securely joining abutting screed sections. The conjunction assembly includes a male joiner piece and a female joiner piece, each piece having a bearing surface for mating against the opposing piece. Each joiner piece preferably includes both horizontal and vertical wing surfaces for attachment to horizontal and vertical screed structure surfaces, thus providing rigidity in two dimensions.

The preferred bearing surfaces are a male, spherical projection and a female, spherical depression. A preferred embodiment includes a hole longitudinally counter bored through both pieces for insertion of a faster such as a bolt and lock nut. A preferred embodiment further includes a plug for insertion over both ends of the fastener after the fastener has secured the male and female pieces together with the desired alignment. The invention thus provides a connection that is strong in shear, protected from concrete buildings on mating surfaces of fasteners and parts, and resistant to wear by concrete dust.

The invention also provides a laser screed alignment system including a laser emitter and target. The target is preferably translucent and includes graduated markings. In use, the target may be slid along the tubular housings and turnbuckles, allowing alignment of each tubular housing section and each screed section. In use, the target may also be left in position on the screed, providing continual indication of actual screed camber.

DETAILED DESCRIPTION OF THE INVENTION

Figure 1:
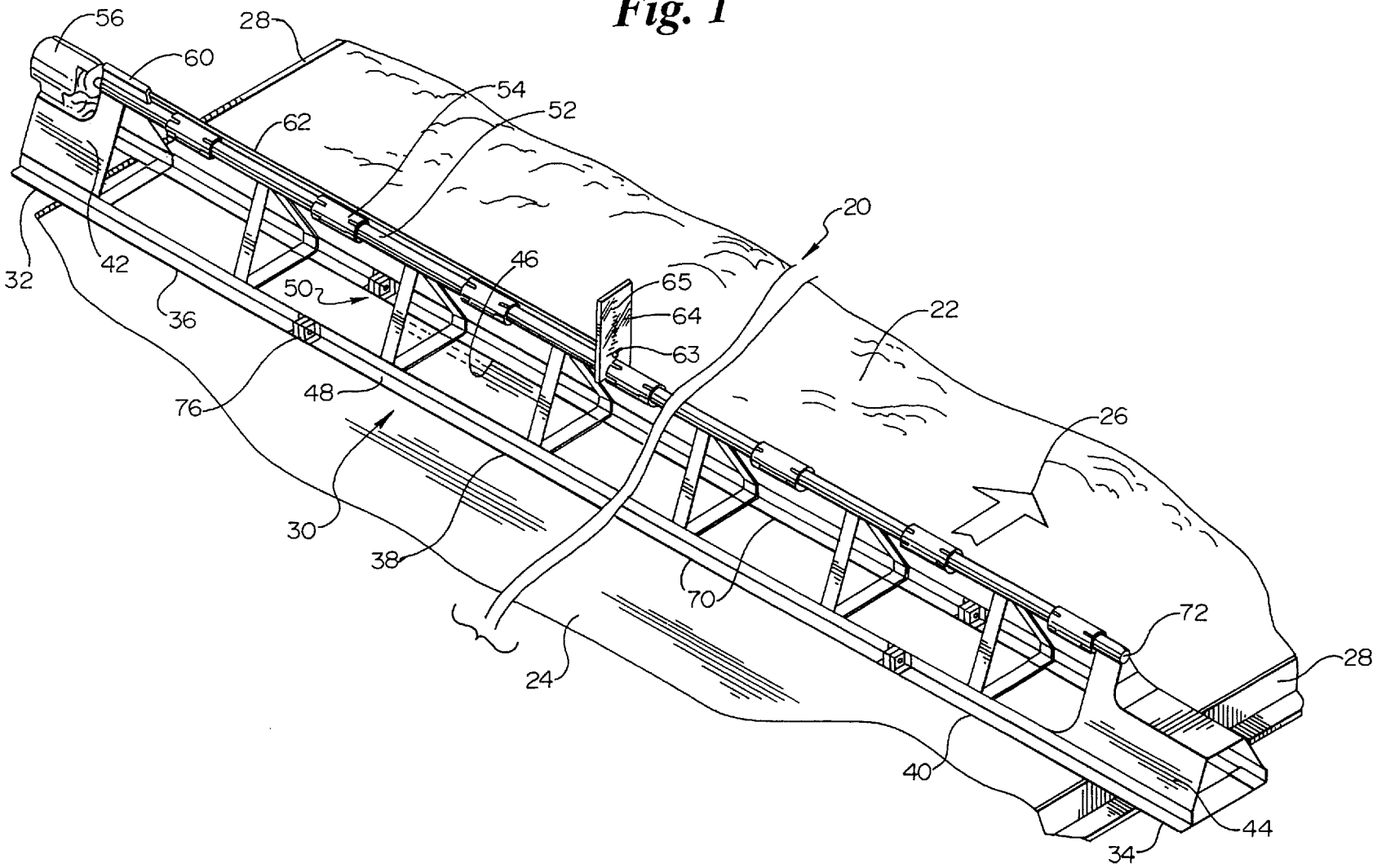
FIG. 1 is a perspective view of a vibratory concrete screed.

FIG. 1 illustrates a vibratory concrete screed 20 embodying the present invention. Screed 20 is illustrated in use, vibrating and passing over wet concrete 22 in direction 26, causing the concrete to slump and forming a smooth surface 24. Screed 20 has a longitudinal axis, extending from a first end portion 32 to a second end portion 34. End portions 32 and 34 typically rest on concrete forms 28. A screed structure 30 is indicated generally at 30. One preferred embodiment structure is a truss frame. Another embodiment is a beam structure (not shown). A preferred embodiment screed structure is formed from several screed sections, illustrated as a first screed section 36, a second screed section 38, and a third screed section 40. A preferred embodiment includes a first end frame 42 and a second end frame 44. Screed structure 30 includes a bottom, flat screeding surface 70, including in FIG. 1 a toe iron 46 at the screed front and a heel iron 48 at the screed rear. The structure embodiment shown includes a truss, indicated generally at 50.

Sections of tubular housing 52 are connected to turnbuckles 54, preferably extending longitudinally along the top of screed 20. Turnbuckle 54 may be tightened or loosened, serving as a means for tensioning screed 20 and adjusting the camber of flat screeding surface 70. In a preferred embodiment, tubular housing 52 and turnbuckle 54 have an interior space 72 extending therethrough.

A preferred embodiment includes a vibratory motor 56 driving an elongate rotating shaft having eccentric weights (not shown in FIG. 1) within tubular housings 52 and turnbuckles 54. A screed section conjunction assembly 76 is shown securing first section 36 to abutting section 38.

A preferred embodiment further includes a laser source 60, illustrated emitting laser beam 62, and laser target 64 for aligning screed 20. A preferred target 64 is translucent and can include a through hole 63 which can serve as an alignment indicator to indicate the desired laser beam position for a level concrete surface. Other "bullseye" means could be employed. One embodiment includes graduated markings 65 above and below hole 63. In use, target 60 is fitted along the top of tubular housings 52 over the length of the screed. The desired camber of the screed may thus be adjusted for each screed section and each tubular housing section. After initial set up, a target may be left in place at a desired location as illustrated in FIG. 1. This provides a constant indication of overall screed alignment during use.

Figure 2:
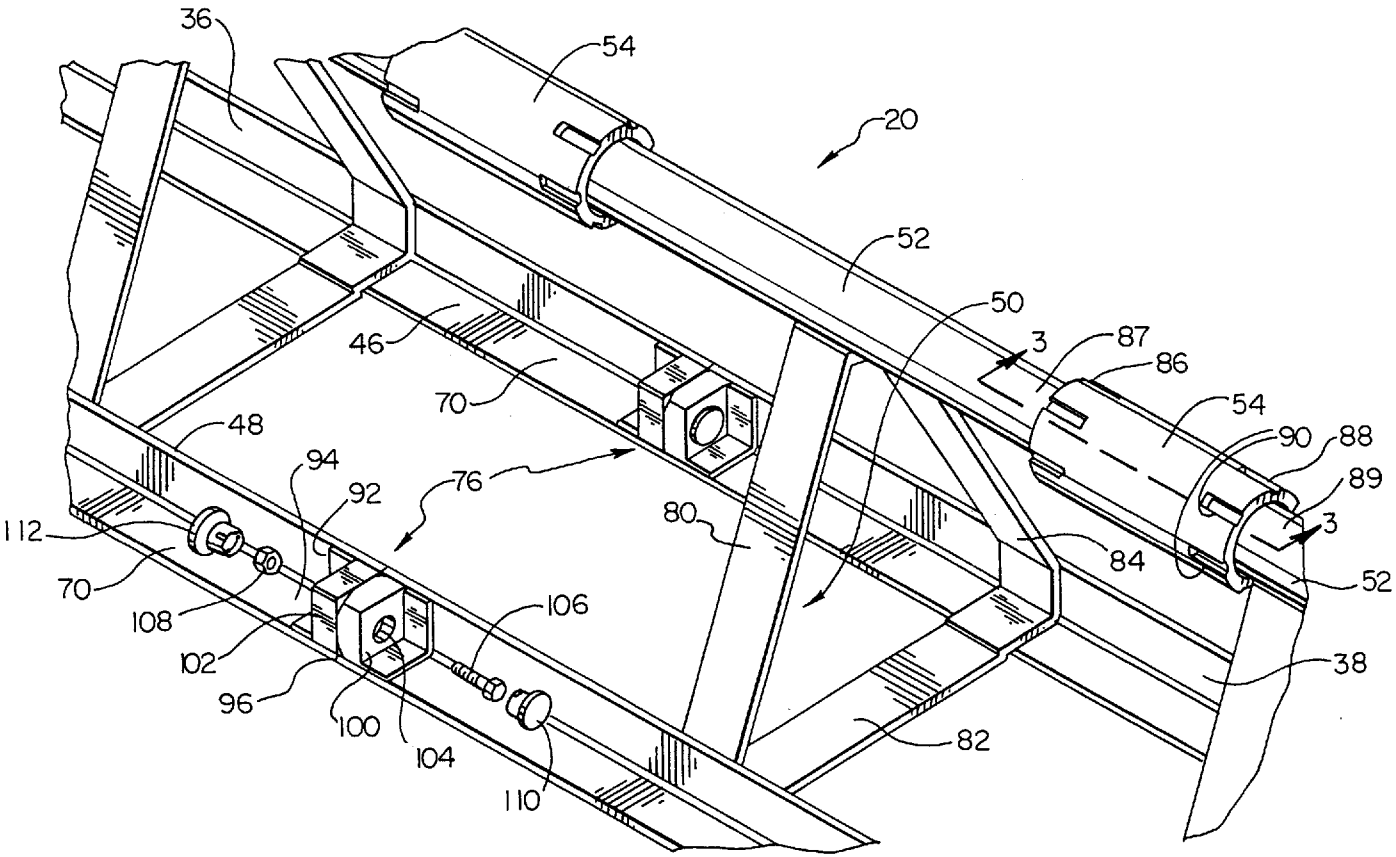
FIG. 2 is an fragmentary expanded view of the concrete screed of FIG. 1.

FIG. 2 illustrates a portion of screed 20 depicted in FIG. 1. Frame member 50 in a preferred embodiment is formed from a trace 80, a purchase 84, and a bridge 82. Frame member 50 is attached to toe iron 46 at front, heel iron 48 at rear, and tubular housing 52 at top. In a preferred embodiment, frame member 50 is attached to toe iron 46, heel iron 48, and tubular housing sections 52 by bolts (not shown) in order to render screed 20 disassemblable.

Alternating tubular housings 52 and turnbuckles 54 are illustrated at the top portion of screed 20, and can include a drive shaft and eccentric weights within (not shown in FIG. 2). In a preferred embodiment, turnbuckle 54 is threaded in a first direction at a first end 86 and threaded in a second direction at a second end 88. Tubular housing 52 is correspondingly threaded at a first end 87 and a second end 89. Turnbuckle 54 may be turned by applying a spanner wrench to spanner flutes 90. Rotating turnbuckle 54 in a first direction causes the overall length of tubular housings 52 and turnbuckles 54 to decrease, causing the downward camber of local bottom screeding surface 70 to increase. Rotating turnbuckle 54 in a second, opposite direction causes the overall length of tubular housings 52 and turnbuckles 54 to increase, causing the upward camber of local bottom screeding surface 70 to increase.

Adjusting the screed surface camber by rotating turnbuckles 54 causes first screed section 36 to move relative to second screed section 38 at conjunction assemblies 76. The sections of screeding surface 70 abut along seam 96, which is preferably tight and well defined to decrease spoilage of the concrete surface. Assemblies 76 include a first, male joiner piece 100 and a second, female joiner piece 102, both preferably attaching to vertical portions 92 and horizontal portions 94, of screed structure 30. The attachment to both horizontal and vertical surfaces imparts rigidity to the screed structure. Male piece 100 and female piece 102 meet along respective bearing surfaces (not visible in FIG. 2) which are substantially inaccessible to concrete.

A preferred embodiment includes a counter bored hole 104 through both male and female pieces 102 and 104. A preferred fastener, including a bolt 106 and a locking hex nut 108, is shown extending through hole 104. Bore 104 is preferably large enough to allow slipping a socket wrench over both bolt 106 and nut 108, to allow for easy adjustment. End caps 110 and 112 preferably slip over both bolt and nut to deny easy access to concrete.

Figure 3:
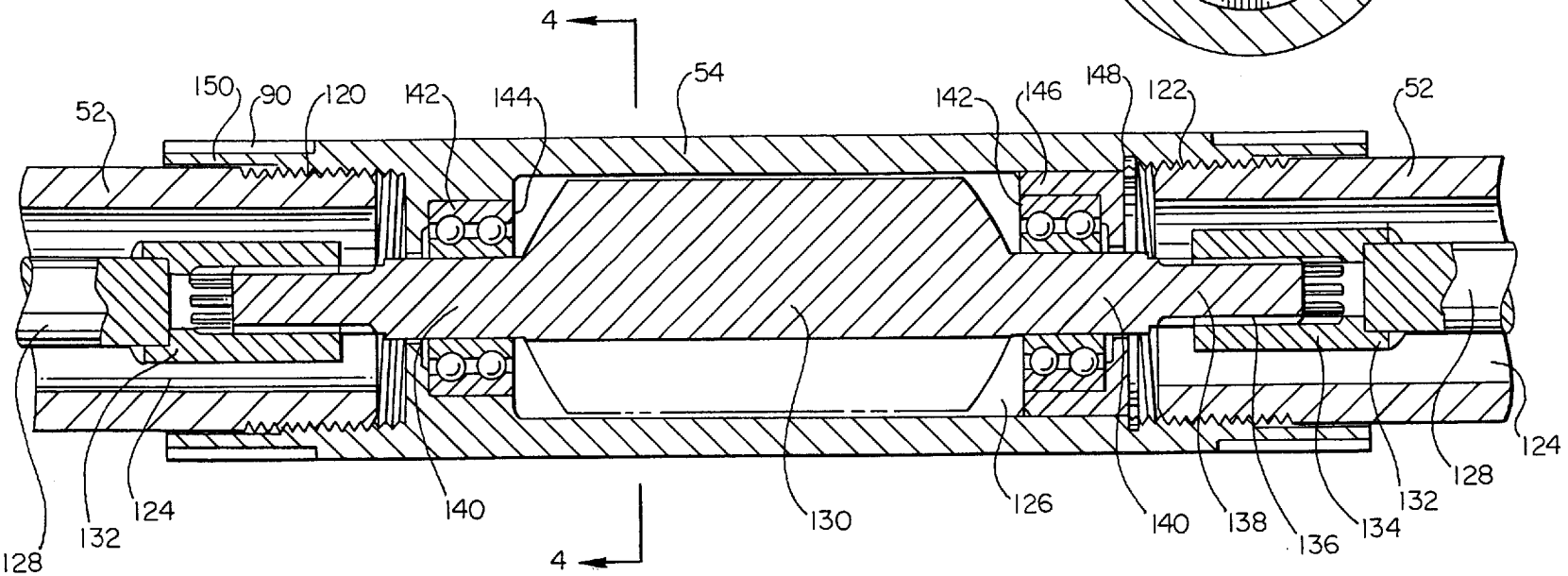
FIG. 3 is a longitudinal cross-sectional view of the concrete screed of FIG. 2 taken through 3—3, illustrating turnbuckle, tubular housing, and eccentric weight.

FIG. 3 illustrates in greater detail turnbuckle 54 and tubular housings 52. Turnbuckle 54 as shown, is adapted to mate with tubular housings 52 using a left hand thread 120 and a right hand thread 122. Turnbuckle 54 includes an interior space 126 and tubular housings 52 include interior space 124. Extending longitudinally through spaces 124 and 126 are drive shafts 128 connected through eccentric weight 130. Eccentric weights 130 are a preferred means for imparting vibration to the concrete screed, causing vibration upon rotation about the longitudinal axis. In one embodiment, drive shaft 128 includes a connector portion 132 having female splines 134, which engage male splines 136 on spline shaft 138 which is an extension of axle 140 extending from eccentric weight 130.

A preferred embodiment includes bearings for centering eccentric weights 130 and/or drive shafts 128 within either tubular housings 52 or turnbuckles 54. The bearings can be located within either turnbuckle 54 or tubular housing 52 or both. A preferred embodiment, illustrated in FIG. 3, includes ball bearings 142 inserted into blind bearing nest 144.

The device depicted in FIG. 3 may be assembled by providing a first tubular housing 52, inserting a drive shaft 128 within such that connector 132 is within and near the end of the tubular housing. Turnbuckle 54 is then screwed over tubular housing 52, bearing 142 slipped over axle 140, and axle 140 and weight 130 inserted into the turnbuckle/tubular housing combination. Bearings 142 may then be slipped over axle 140 and positioned with sabot 146. A snap ring 148 or other bearing retention means may be used to fix weight, bearings and sabot in place. A second tubular housing 52 may then be screwed into turnbuckle 54 and the process repeated.

A preferred embodiment utilizes a turnbuckle 54 having female threads over male threads on tubular housings 52, including a sleeve portion 150 for protecting otherwise exposed male threads. This could be reversed, with female threads in the tubular housings and male threads in the turnbuckles. As illustrated in FIG. 3, the drive shafts, bearings, threads, and rotating weights are all protected from spattering wet concrete and concrete dust as well as other environmental hazards.

Figure 4:
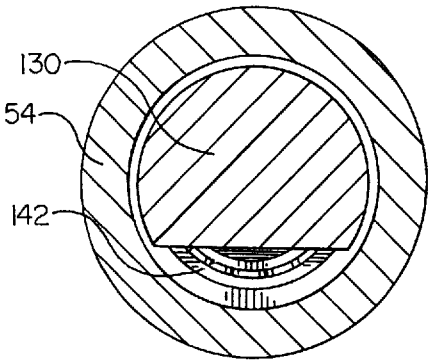
FIG. 4 is a transverse cross-sectional view of the concrete screed of FIG. 3 taken through the eccentric weight at 4—4.

FIG. 4 illustrates a cross section of eccentric weight 130 within turnbuckle 54, and further illustrating ball bearings 142. "Eccentric" weight 130 refers to the distribution of weight about the longitudinal axis, and is achieved in a preferred embodiment utilizing a common material for weight, axle, and spline shaft.

Figure 5:
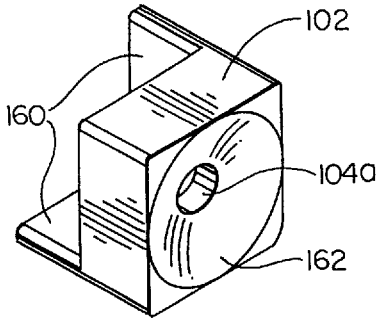
FIG. 5 is a perspective view of a concrete screed attachment device having a spherical depression bearing surface.

FIG. 5 illustrates in greater detail female joiner piece 102 depicted in FIG. 2, including bore 104*a* longitudinally through piece 102. Female piece 102 includes a bearing surface 162, which in the embodiment of FIG. 5, is a spherical depression. Wings 160 include both vertical and horizontal portions for rigid attachment to the screed structure.

Figure 6:
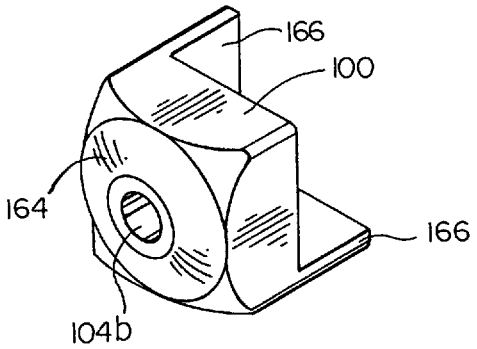
FIG. 6 is a perspective view of a concrete screed attachment device having a spherical projection bearing surface.

FIG. 6 illustrates male joiner piece 100 depicted in FIG. 2, including bore 104*b* longitudinally through the piece. Male piece 100 has a bearing surface 164, illustrated in FIG. 6 as a spherical projection. Projections and depressions more conical than those shown in FIGS. 5 and 6 are also within the scope of the invention.

FIGS. 5 and 6 together illustrate the bearings surfaces that, when brought together, provide an interface that is highly resistant to penetration by concrete. The bearing surfaces allow for variations in alignment by variations in alignment of bores 104*a* and 104*b*. This alignment, once fixed by fasteners 106 and 108, provide for a rigid fixation of the desired screeding surface geometry.

Figure 7:
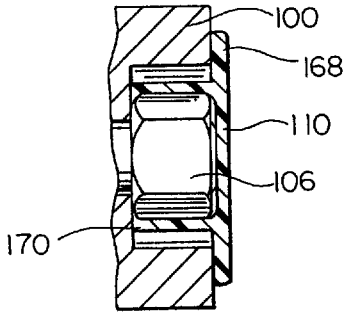
FIG. 7 is a longitudinal cutaway view of a fastener within a counterbore within the concrete screed attachment device depicted in FIG. 6.

FIG. 7 illustrates plug 110 depicted in FIG. 2, for fitting over the head of either bolt 106 or nut 108 within either male joiner piece 100 or female 102. As illustrated in FIG. 7, plug 110 includes a flange 168 and snap rim 170 for fitting over the head of bolt 160 within male joiner 100. In a preferred embodiment, plug 110 is formed of a hard plastic. As shown, plug 100 shields bolt 106 from much of the contamination it would otherwise encounter from wet splattering concrete and dried concrete dust. This protects the bolt threads from wear by abrasive dust.

Numerous characteristics and advantages of the invention covered by this document have been set forth in the forgoing description. It will be understood, however, that this disclosure is, in many respects, only illustrative. Changes may be made in details without exceeding the scope of this invention. The invention's scope is, of course, defined in the language in which the appended claims are expressed.

It will be understood that this disclosure, in many respects, is only illustrative. Changes may be made in details, particularly in matters of shape, size, material, and arrangement of parts without exceeding the scope of the invention. Accordingly, the scope of the invention is as defined in the language of the appended claims.

What is claimed is:

1. A vibratory concrete screed having a longitudinal axis, for placement across a wet concrete section to be smoothed, and extending from a first end to a second end, a transverse axis normal to said longitudinal axis and extending from a front portion to a rear portion, and a vertical axis extending from a bottom portion to a top portion, said transverse axis being generally horizontal, said vertical axis being generally vertical, including:

a truss structure having a substantially longitudinal orientation;

a screeding surface secured to said truss structure bottom portion, said screeding surface disposable with an upward camber, a downward camber, and a substantially horizontal planar orientation;

means for tensioning said truss structure, said tensioning means having a substantially longitudinal orientation, whereby increasing the tension of said tensioning means increases said screeding surface downward camber and decreasing the tension of said tensioning means increases said screeding surface upward camber;

said tensioning means having an interior space; and means for vibrating said screed structure, said vibrating means residing substantially within said tensioning means interior space.

2. A vibratory concrete screed having a longitudinal axis for placement across a wet concrete section to be smoothed and extending from a first end to a second end, a transverse axis normal to said longitudinal axis and extending from a front portion to a rear portion, and a vertical axis extending from a bottom portion to a top portion, said transverse axis being substantially horizontal relative to the earth, said vertical axis being substantially vertical to the earth, comprising:

a screed structure having a substantially longitudinal orientation;

a screeding surface secured to said screed structure bottom portion, said screeding surface capable of assuming an upward camber, a downward camber, and a substantially horizontal planar orientation;

means for tensioning said screed structure, said tensioning means having an interior space and a substantially longitudinal orientation, whereby increasing the tension of said tensioning means increases said screeding surface downward camber and decreasing the tension of said tensioning means increases said screeding surface upward camber;

means for vibrating said screed structure, said vibrating means residing substantially within said tensioning means interior space.

3. A concrete screed as recited in claim 2 wherein said tensioning means includes at least two tubular housings and a turnbuckle, said tubular housings and turnbuckle having oppositely disposed ends and portions adapted to mate with each other, whereby turning said turnbuckle in a first direction draws said tubular housings disposed at either turnbuckle end closer together and turning said turnbuckle in a second direction pushes said tubular housings further apart.

4. A concrete screed as recited in claim 3 wherein said tubular housings and turnbuckle are threaded.

5. A concrete screed as recited in claim 4 wherein said tubular housing threads are male and said turnbuckle threads are female.

6. A concrete screed as recited in claim 3 wherein said vibrating means includes an elongate shaft, said shaft having a longitudinal axis, said shaft including eccentric portions which are eccentrically weighted relative to said longitudinal axis.

7. A concrete screed as recited in claim 6, wherein said eccentric portions reside substantially within said turnbuckles.

8. A concrete screed as recited in claim 2 wherein said screed structure includes at least two sections abutting each other longitudinally and attached to one another, each of said sections having at least one first bearing surface adapted to mate with a second bearing surface on said longitudinally abutting section.

9. A concrete screed as recited in claim 8 wherein said first bearing surface is male and said second bearing surface is female.

10. A concrete screed as recited in claim 9 wherein said first bearing surface is a spherical projection and said second bearing surface is a spherical depression.

11. A concrete screed as recited in claim 10 wherein said first and second bearing surfaces include a longitudinal bore and a fastening member for securing said first bearing surface to said second bearing surface, said fastening member extending through said longitudinal bore.

12. A concrete screed as recited in claim 2 further comprising a laser alignment system including a longitudinally projecting laser source mounted on said screed device and at least one target adapted to be mounted on said screed device.

* * * * *